US009355806B2

(12) United States Patent
Umbach

(10) Patent No.: US 9,355,806 B2
(45) Date of Patent: May 31, 2016

(54) CATHODE ASSEMBLY FOR USE IN A RADIATION GENERATOR

(71) Applicant: Schlumberger Technology Corporation, Sugar Land, TX (US)

(72) Inventor: Brian Umbach, Millstone, NJ (US)

(73) Assignee: Schlumberger Technology Corporation, Sugar Land, TX (US)

( * ) Notice: Subject to any disclaimer, the term of this patent is extended or adjusted under 35 U.S.C. 154(b) by 204 days.

(21) Appl. No.: 13/945,589

(22) Filed: Jul. 18, 2013

(65) Prior Publication Data

US 2015/0022080 A1 Jan. 22, 2015

(51) Int. Cl.

| | |
|---|---|
| ***H01J 1/94*** | (2006.01) |
| ***H01J 9/18*** | (2006.01) |
| ***H01J 43/00*** | (2006.01) |
| ***H01J 1/18*** | (2006.01) |
| ***H01J 3/04*** | (2006.01) |
| ***H01J 35/06*** | (2006.01) |
| ***H05H 3/06*** | (2006.01) |
| ***H01J 1/16*** | (2006.01) |
| ***H01J 27/02*** | (2006.01) |
| ***H01J 3/02*** | (2006.01) |

(52) U.S. Cl.

CPC ... *H01J 1/94* (2013.01); *H01J 1/16* (2013.01); *H01J 1/18* (2013.01); *H01J 3/027* (2013.01); *H01J 3/04* (2013.01); *H01J 9/18* (2013.01); *H01J 27/022* (2013.01); *H01J 35/06* (2013.01); *H01J 43/00* (2013.01); *H05H 3/06* (2013.01)

(58) Field of Classification Search

CPC ..... G11C 11/00; G11C 11/23; H05H 3/00; H05H 3/06; H01J 1/00; H01J 1/16; H01J 1/18; H01J 1/94; H01J 27/00; H01J 27/022; H01J 29/00; H01J 29/395; H01J 3/00; H01J 3/04; H01J 3/027; H01J 31/00; H01J 31/18; H01J 31/60; H01J 31/64; H01J 35/00; H01J 35/06; H01J 43/00; H01J 9/00; H01J 9/18

USPC ..... 315/12.1

See application file for complete search history.

(56) References Cited

U.S. PATENT DOCUMENTS

| | | | | |
|---|---|---|---|---|
| 8,264,134 | B2 * | 9/2012 | Tuma et al. | 313/344 |
| 2007/0076849 | A1 * | 4/2007 | Bard et al. | 378/121 |

(Continued)

FOREIGN PATENT DOCUMENTS

| | | | |
|---|---|---|---|
| DE | 10012203 | C1 | 7/2001 |
| JP | S59184431 | A | 10/1984 |
| JP | H02215023 | A | 8/1990 |

(Continued)

OTHER PUBLICATIONS

International Search Report and the Written Opinion for International Application No. PCT/US2014/045375 dated Oct. 23, 2014.

*Primary Examiner* — John Poos
*Assistant Examiner* — David Mattison
(74) *Attorney, Agent, or Firm* — Michael Dae

(57) ABSTRACT

A cathode assembly is for use in a radiation generator and includes an ohmically heated cathode, and a support having formed therein a hole and a recess at least partially surrounding the hole. In addition, there is a mount coupled to the support. The mount includes a larger outer frame positioned within the recess, a smaller inner frame carrying the ohmically heated cathode and spaced apart from the larger outer frame, and a plurality of members coupling the smaller inner frame to the larger outer frame.

27 Claims, 7 Drawing Sheets

(56) References Cited

U.S. PATENT DOCUMENTS

| | | | | |
|---|---|---|---|---|
| 2009/0146052 | A1* | 6/2009 | Groves et al. | 250/269.4 |
| 2011/0114830 | A1 | 5/2011 | Reijonen et al. | |
| 2013/0180780 | A1* | 7/2013 | Chirovsky et al. | 175/50 |

FOREIGN PATENT DOCUMENTS

| | | | |
|---|---|---|---|
| JP | 2001084932 | A | 3/2001 |
| WO | 2009013677 | A1 | 1/2009 |
| WO | 2013096487 | A1 | 6/2013 |

* cited by examiner

CATHODE ASSEMBLY FOR USE IN A RADIATION GENERATOR

FIELD OF THE DISCLOSURE

This disclosure relates to the field of radiation generators, and, more particularly, to cathode assemblies for use in radiation generators.

BACKGROUND

Well logging instruments that utilize radiation generators, such as sealed-tube neutron generators, have proven incredibly useful in oil formation evaluation. Such a neutron generator may include an ion source and a target. Some ion sources operate by emitting electrons from a cathode, and accelerating those electrons to suitable energies in the presence of an ionizable gas. Once the ions are created by interactions between the electrons and the ionizable gas, they are accelerated to a target that emits neutrons when struck by the ions. Therefore, the rate of neutron production in such a radiation generator is related to the rate of ion production, which in turn is related to the rate of electron production.

Consequently, it is desirable for the production of electrons to remain substantially constant in such a radiation generator, and the creation of new cathode assemblies that help to provide a substantially constant electron output is desirable.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In accordance with the present disclosure, a cathode assembly for use in a radiation generator may include a support having formed therein a hole and a recess at least partially surrounding the hole. The cathode assembly may also include an ohmically heated cathode, and a mount coupled to the support. The mount may include a larger outer frame positioned within the recess, a smaller inner frame carrying the ohmically heated cathode and spaced apart from the larger outer frame, and a plurality of members coupling the smaller inner frame to the larger outer frame.

Another aspect is directed to a radiation generator that may include a housing to contain an ionizable gas, an extractor electrode carried within the housing, and a cathode assembly carried within the housing. The cathode assembly may include an ohmically heated cathode and support having formed therein a hole and a recess at least partially surrounding the hole. The cathode assembly may also include a mount coupled to the support. The mount may include a larger outer frame positioned within the recess, a smaller inner frame carrying the ohmically heated cathode and spaced apart from the larger outer frame, and a plurality of members coupling the smaller inner frame to the larger outer frame. The cathode assembly may also include a cathode grid downstream of the ohmically heated cathode, with the cathode grid and the ohmically heated cathode having a voltage difference such that the ohmically heated cathode emits electrons in a downstream direction toward the extractor electrode. The cathode grid and the extractor electrode may have a voltage difference such that the electrons are decelerated toward the extractor electrode, at least some of the electrons as they travel interacting with the ionizable gas to form ions. There may be a target carried within the housing downstream of the extractor electrode, and the extractor electrode and the target may have a voltage difference such that the ions are accelerated downstream toward the target, the target to emit radiation when struck by at least some of the ions.

A further aspect is directed to a radiation generator that may include a housing, with an extractor electrode carried within the housing, and a cathode assembly carried within the housing. The cathode assembly may include an ohmically heated cathode, and support having formed therein a hole and a recess at least partially surrounding the hole. A mount may be coupled to the support and may include a larger outer frame positioned within the recess, a smaller inner frame carrying the ohmically heated cathode and spaced apart from the larger outer frame, and a plurality of members coupling the smaller inner frame to the larger outer frame. In addition, there may be a cathode grid downstream of the ohmically heated cathode, and the cathode grid and the ohmically heated cathode may have a voltage difference such that the ohmically heated cathode emits electrons in a downstream direction toward the extractor electrode. Also, the cathode grid and the extractor electrode may have a voltage difference such that the electrons are accelerated toward the extractor electrode. There may be a target carried within the housing downstream of the extractor electrode. The extractor electrode and the target may have a voltage difference such that the electrons are accelerated downstream toward the target, the target to emit radiation when struck by at least some of the electrons.

A method aspect is directed to a method of making a cathode assembly for use in a radiation generator. The method may include forming a hole and a recess at least partially surrounding the hole in a support, and coupling a mount to the support. The mount may be coupled to the support by positioning a larger outer frame within the recess, positioning an ohmically cathode in a smaller inner frame spaced apart from the larger outer frame, and coupling the smaller inner frame to the larger outer frame using a plurality of members.

DETAILED DESCRIPTION

One or more embodiments of the present disclosure will be described below. These described embodiments are only examples of the presently disclosed techniques. Additionally, in an effort to provide a concise description, all features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill in the art having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

For clarity in descriptions, when the term "downstream" is used, a direction toward the target of a radiation generator tube is meant, and when the term "upstream" is used, a direction away from the target of a radiation generator tube is meant. In addition, when any voltage or potential is referred to, it is to be understood that the voltage or potential is with respect to a reference voltage, which may or may not be ground. The reference voltage may be the voltage of the active cathode as described below, for example. Thus, when a "positive" voltage or potential is referred to, that means positive with respect to a reference voltage, and when a "negative" voltage of potential is referred to, that means negative with respect to a reference voltage.

This disclosure relates to cathode assemblies for use in radiation generators. So that the use of such cathode assemblies, as well as the usefulness thereof, is readily apparent, two types of commonly used radiation generators will now be described.

Figure 5:
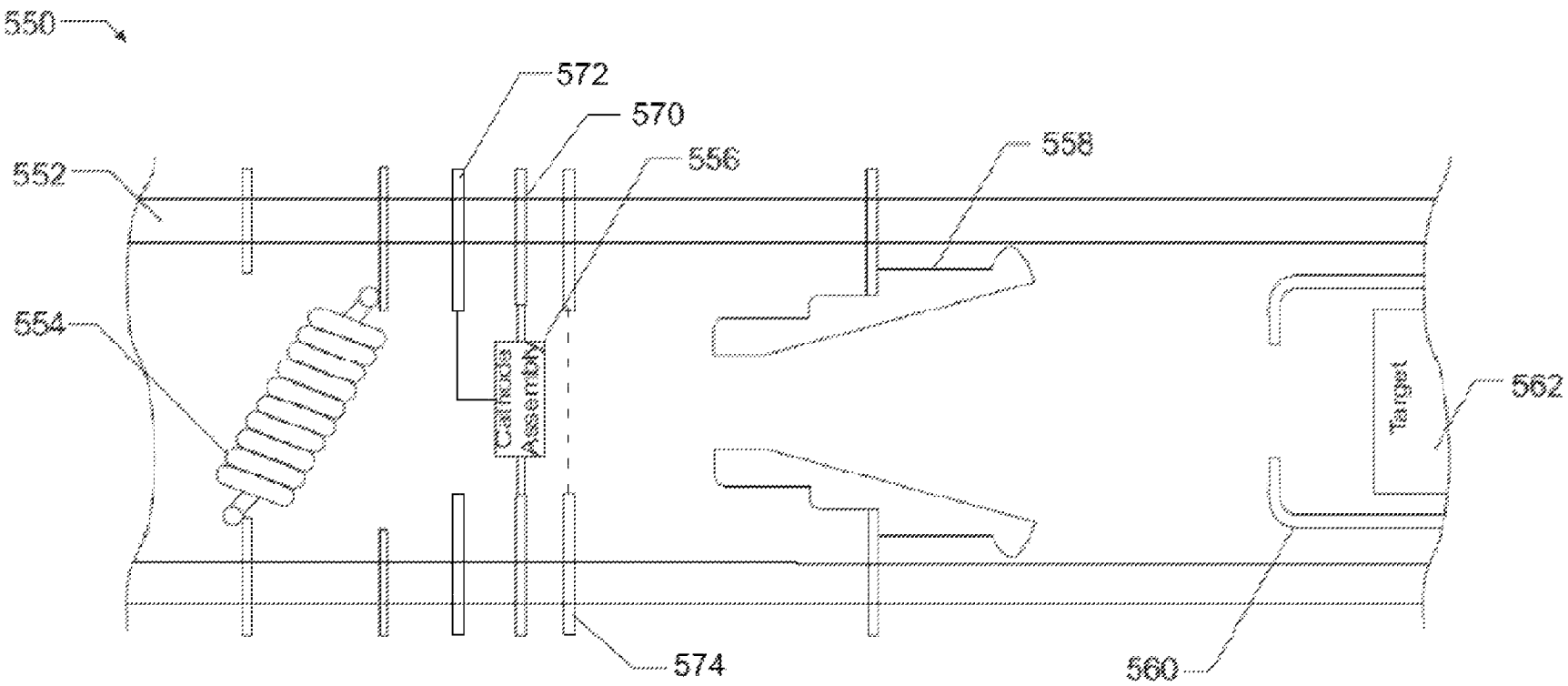
FIG. 5 illustrates an example radiation generator in which the cathode assemblies of the present disclosure may be used.

Referring now to FIG. 5, a neutron generator tube 550 is now described. The neutron generator tube 550 comprises a hermetically sealed envelope 552 or housing, which may be constructed from one or more insulators, such as $Al_2O_3$. At least one ionizable gas, such as deuterium or tritium, is contained within the hermetically sealed envelope 552 at a pressure of 1 mTorr to 20 mTorr, for example. A gas reservoir 554, such as a getter, stores and supplies this gas and can be used to adjust this gas pressure. It should be understood that the gas reservoir 554 may be located anywhere in the hermetically sealed envelope 552.

The cathode assembly 556 contains an active cathode that emits electrons in a downstream direction toward an extractor electrode 558. A voltage difference between the cathode assembly 556 and the cathode grid 574 accelerates the electrons as they travel downstream toward the extractor electrode. As the electrons travel downstream, at least some interact with the ionizable gas to form ions, such as deuterium or tritium ions or molecular ions such as $D_2^+$, $DT^+$ or $T_2^+$. The positive ions are accelerated towards the extractor electrode opening by the positive voltage applied to the extractor electrode 558 with respect to the cathode grid 574.

The cathode in the cathode assembly 556 is heated ohmically by applying a voltage between the cathode support electrode 570 and the cathode power electrode 572. While the cathode power electrode is shown as an additional metallic ring in the ceramic envelope, the voltage could be supplied by a feed-through through the ceramic wall or through the bottom of the neutron generator tube.

The extractor electrode 558, as well as any other optional electrode such as a cylindrical electrode (not shown) between the extractor electrode and the cathode grid 574, shape the electric field such that the ions are attracted or repelled downstream through the extractor electrode. The ions are further accelerated as they travel downstream by the voltage differences between the extractor electrode 558 and a suppressor electrode 560 as well as a target 562. When the ions strike ions embedded in the target 662, fusion reactions such as deuterium-deuterium (d-D), deuterium-tritium (d-T), and tritium-tritium (t-T) reactions, may occur, depending upon what types of ions are accelerated, and depending upon what types of ions are embedded within the target. A product of these fusion reactions is the creation of neutrons, with a d-D fusion reaction creating a 2.45 MeV neutron, a d-T fusion reaction creating a 14.1 MeV neutron, and a t-T fusion creating a pair of neutrons of an undefined energy (but less than 11.3 MeV combined between the pair).

Figure 6:
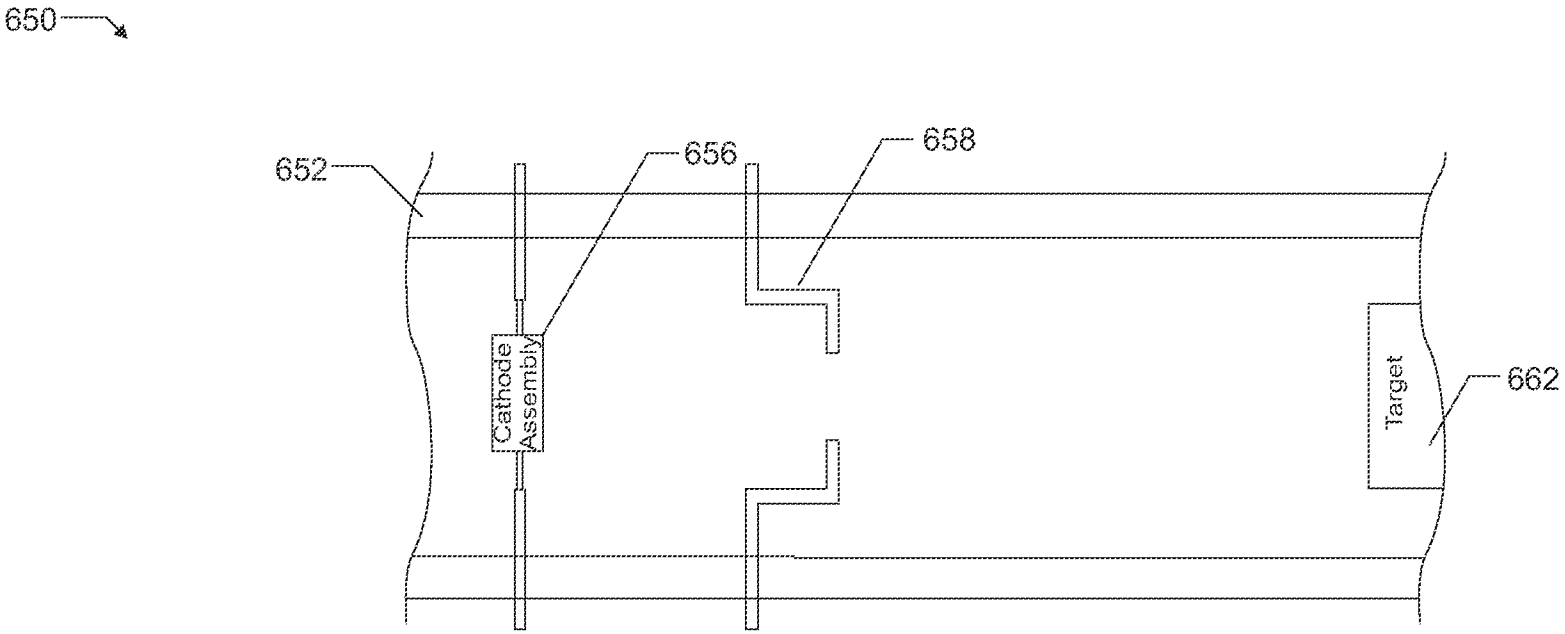
FIG. 6 illustrates another example radiation generator in which the cathode assemblies of the present disclosure may be used.

With reference to FIG. 6, an x-ray generator 650 is now described. The x-ray generator 650 is similar to the neutron generator 550 described above, so merely the differences are described here. The x-ray generator 650 lacks a gas reservoir, and instead contains a vacuum within the hermetically sealed envelope 652. Thus, no ions are created, and instead the electrons from the cathode assembly 556 are accelerated through a focusing electrode 558 and downstream toward the target 662. When the electrons strike the target 662, Bremsstrahlung x-rays and characteristic x-rays of the target material are emitted.

As will be understood by those of skill in the art, the radiation generators 550, 650 can be incorporated into downhole tools , and can be activated when in a hole drilled into a subsurface formation. By detecting incoming radiation resulting from interactions between the neutrons and/or x-rays and the subsurface formation, properties of the subsurface formation, such as porosity, density, and lithology, can be determined.

In either radiation generator 550, 650, consistency in the radiation output (whether neutrons or x-rays), whether the radiation is output in pulses or continuously, is desirable for consistency of results in downhole logging. A factor contributing to consistent radiation output is consistent electron output from the cathode assembly 556, 656.

Figure 1:
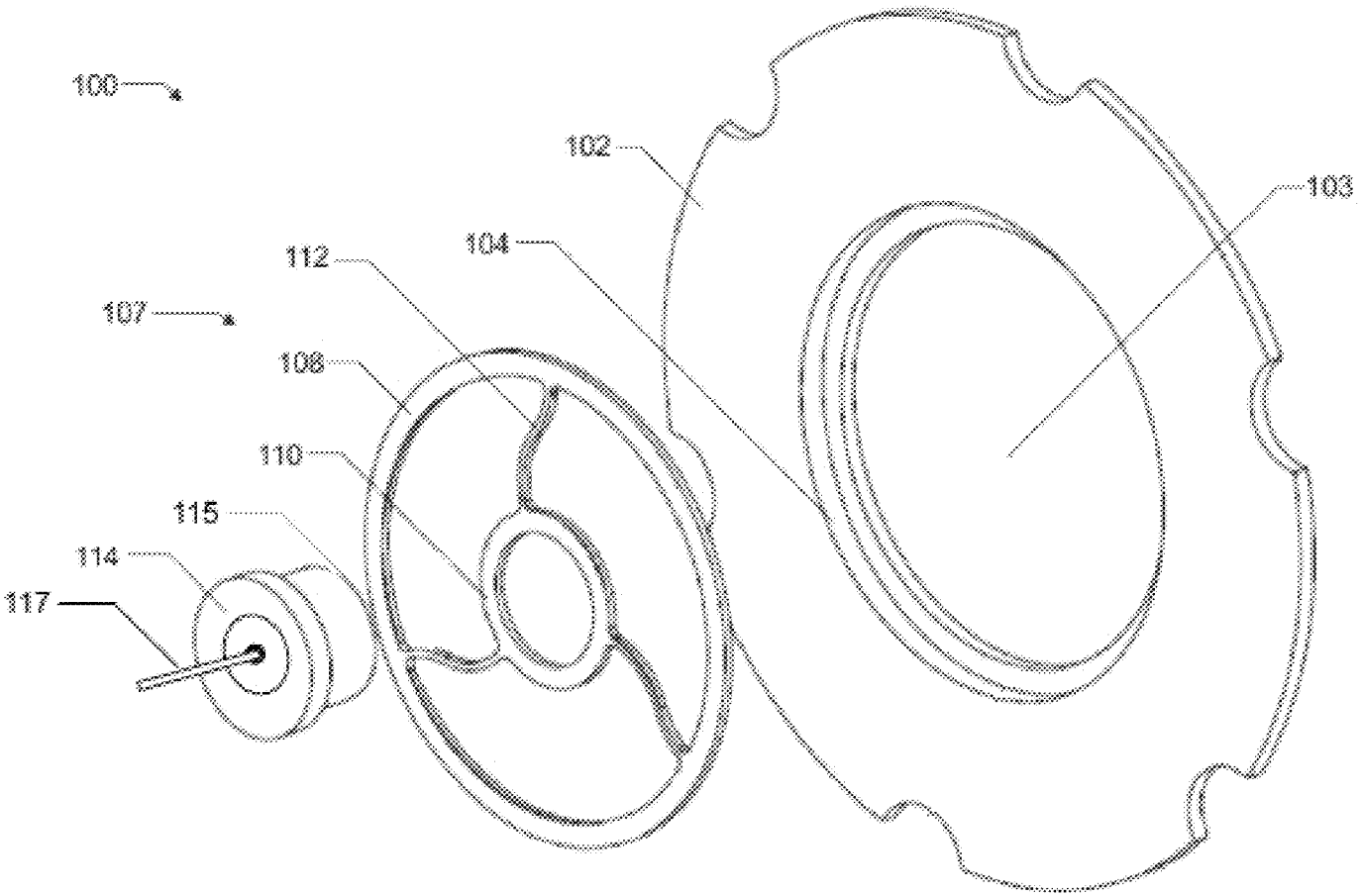
FIG. 1 is an exploded perspective view of a cathode assembly in accordance with the present disclosure.

Moving along, the cathode assembly 100 of the present disclosure helps to provide consistent electron output, and will now be described in detail with initial reference to FIG. 1. The cathode assembly includes a support 102 having a hole 103, as well as a recess 104 at least partially surrounding the hole. The support 102 may be a hollow cylinder, such as a washer, and may have clearance portions cut in an outer diameter thereof, as illustrated. The hole 103 and recess 104 may have circular cross sections.

A mount 107 is coupled to the support 102. The mount includes a larger outer frame 108 positioned within the recess 104, a smaller inner frame 110 spaced apart from the larger outer frame, and a plurality of members 112 coupling the smaller inner frame to the larger outer frame. The larger outer frame 108 and smaller inner frame 110 may also be hollow cylinders, as illustrated.

The smaller inner frame 110 carries an ohmically heated cathode 114. The ohmically heated cathode 114 emits electrons from the active surface 115 via thermionic emission when properly powered. It should be understood that there may be any number of such members 112 and that they may be of any shape. For example, as shown in FIG. 1, the members 112 may extend in a meandering path from the smaller inner frame 110 to the larger inner frame 108. This increases the length of the support and reduces heat losses through heat conduction as explained below.

The ohmic heating of the cathode is achieved by applying an electrical potential across the resistive heater inside the cathode and passing a current through it. The potential may be applied between the outer surface of the cathode 114 and an electrical contact 116 that may be at the bottom of the cathode 114. A cathode wire 117 is connected to an additional electrode (not shown) to which the voltage may be applied.

Figure 2:
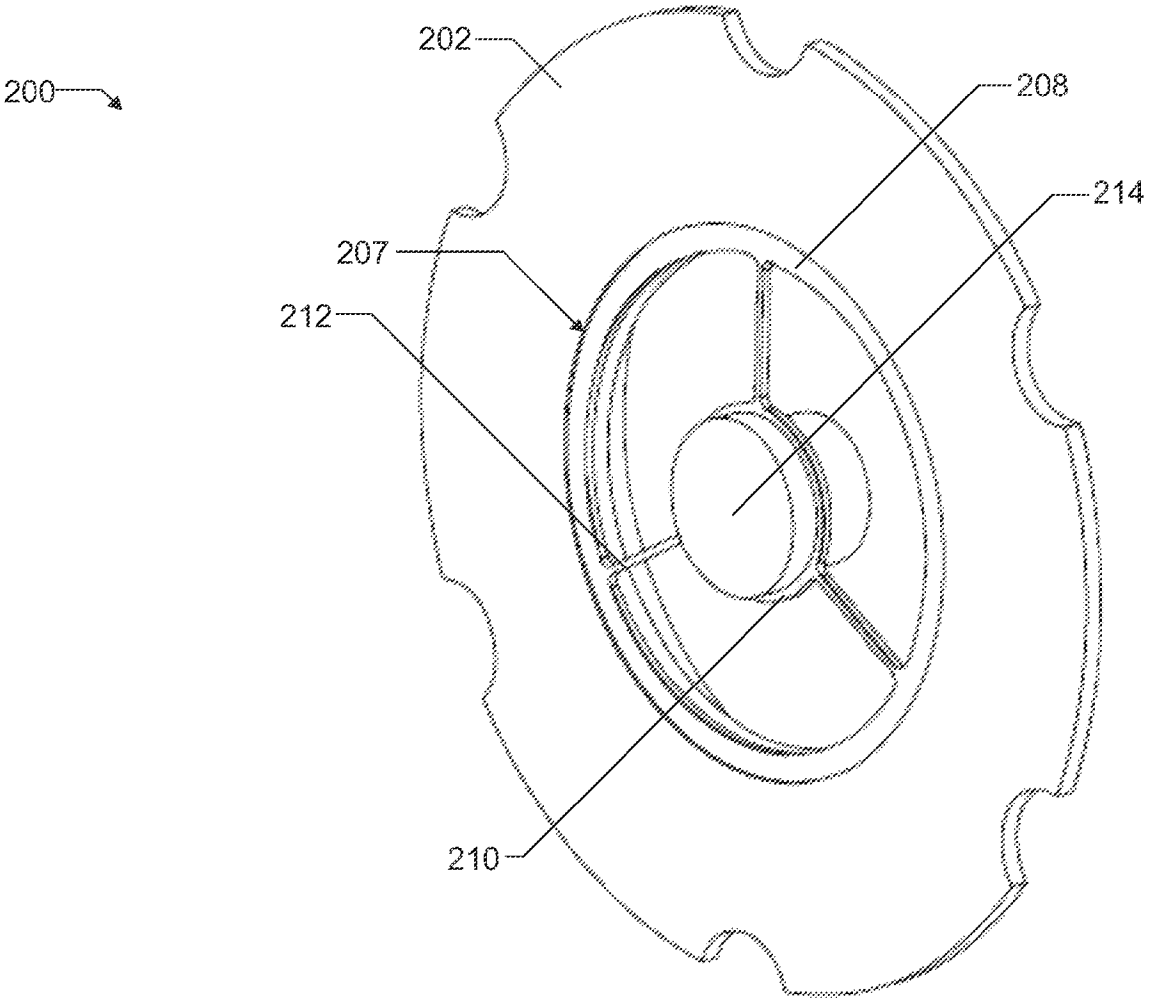
FIG. 2 is a perspective view of an alternative configuration of a cathode assembly in accordance with the present disclosure.
Figure 2A:
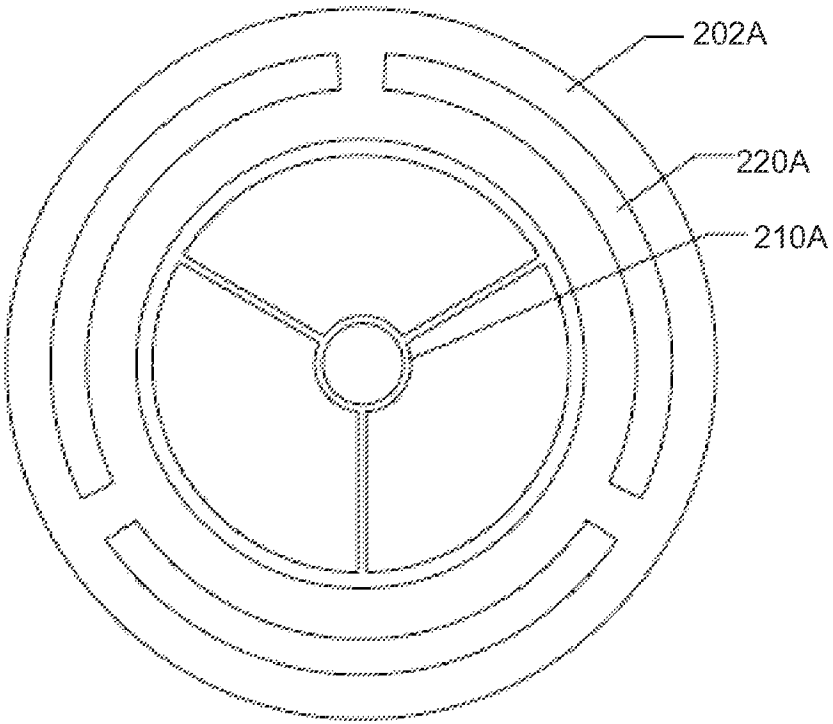
FIG. 2A is a front view of the cathode assembly of FIG. 2.

The members 212 may instead extend in a straight line from the smaller inner frame 210 to the larger outer frame 208, and may extend in a direction orthogonal to the ohmically heated cathode 214, both of which are shown in FIG. 2. In addition, the support 202 may have thermal conduction reducing features 220A, such as holes, slots, projections, or depressions as shown in FIG. 2A. These surface thermal conduction reducing features 220 help to further decrease heat conduction.

Figure 3:
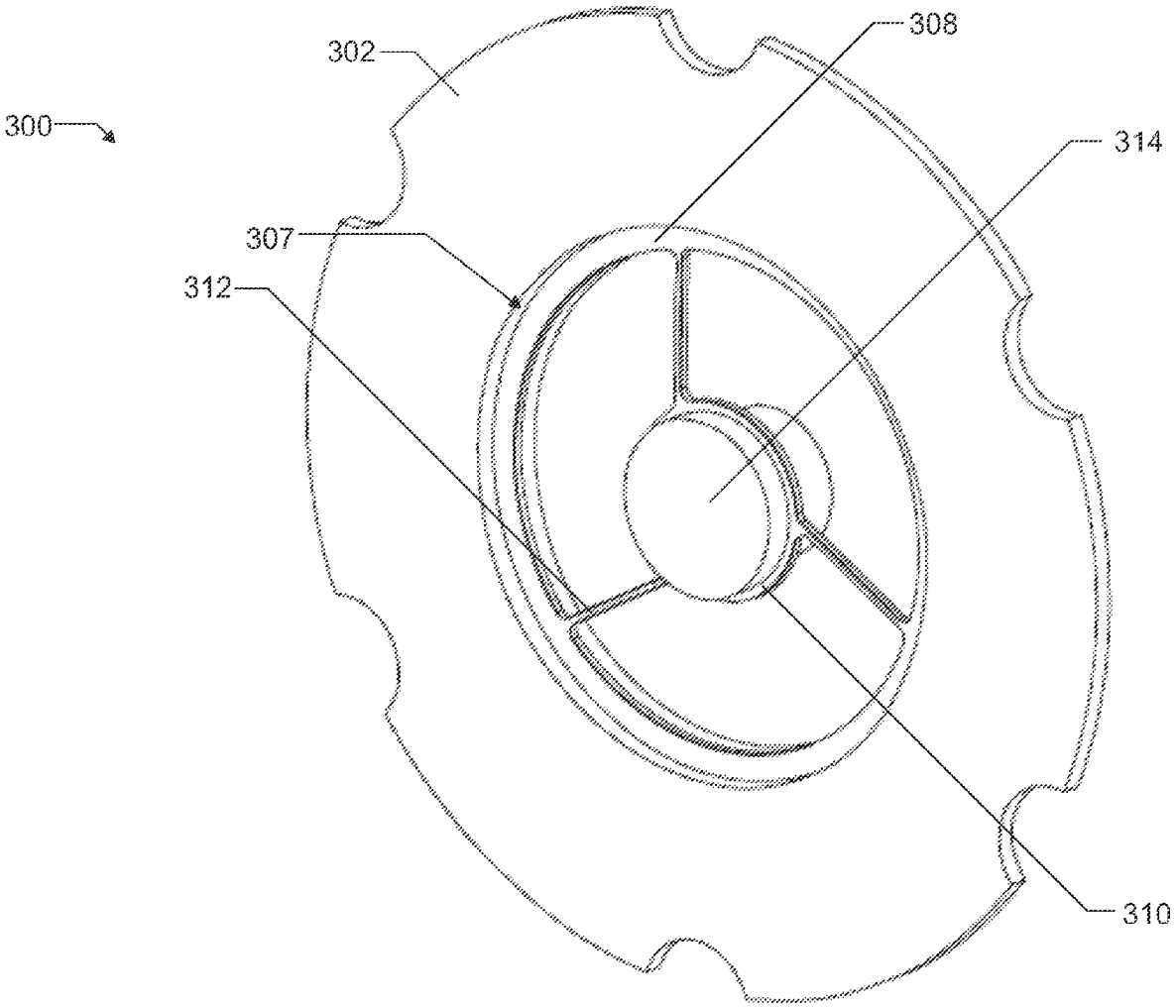
FIG. 3 is a perspective view of another alternative configuration of a cathode assembly in accordance with the present disclosure.

In another configuration, the members 312 may extend in a direction oblique to the ohmically heated cathode 314, as shown in FIG. 3. Although a variety of configurations have been described herein, it is to be understood that each member of the plurality of members 112, 212, 312 need not have a same shape or extend in a same direction from the ohmically heated cathode 114, 214, 314, and that each member may have a different shape and extend in a different direction.

As explained above, consistent electron production in a radiation generator is desirable. One way in which to help keep electron production from the ohmically heated cathode 114, 214, 314 constant is to keep the temperature thereof constant. However, the ohmic heating of the cathode 114, 214, 314 is costly in terms of power consumption, and therefore ways at reducing heat loss from the cathode are desirable. The design of the cathode assembly 100, 200, 300 helps to reduce thermal conduction losses of heat away from the ohmically heated cathode 114, 214, 314. In particular, the members 112, 212, 312 help to space the ohmically heated cathode 114, 214, 314 away from the larger outer frame 108, 208, 308, which in return reduces the heat conduction from the ohmically heated cathode into the mount 107, 207, 307 and support 102, 202, 302.

In addition, this design wherein the larger outer frame 108, 208, 308 is fitted into the support 102, 202, 302 (i.e. such that the larger outer frame and support are coplanar) helps to keep the ohmically heated cathode 114, 214, 314 centered in the hole 103, 203, 303, which helps to provide for consistent output between different radiation generators. In addition, the members 112, 212, 312 help to keep the face of the ohmically heated cathode 114, 214, 314 substantially parallel to an optional cathode grid (shown as 420 in FIG. 4), which helps to properly focus the electron beam, and helps to promote even electron production. Since the larger outer frame 108, 208, 308, smaller inner frame 110, 210, 310, and members 112, 212, 312 are rigid, they are resistant to shock and vibration, helping to ensure consistent and stable performance in harsh environments. While the members 112, 212, 313 are shown as being coplanar as the larger outer frame 108, 208, 308, they need not be, and in some embodiments may be positioned so as to mount the ohmically heated cathode 114, 214, 314 either upstream or downstream of the larger outer frame.

The design of the cathode assembly 100, 200, 300 helps facilitate easy and consistent construction as well. For example, the ohmically heated cathode 114, 214, 314 may be first placed into the smaller inner frame 110, 210, 210, and then brazed thereto so that it remains in place securely. The mount 107, 207, 307 may then be placed into the support and welded into place.

Figure 4:
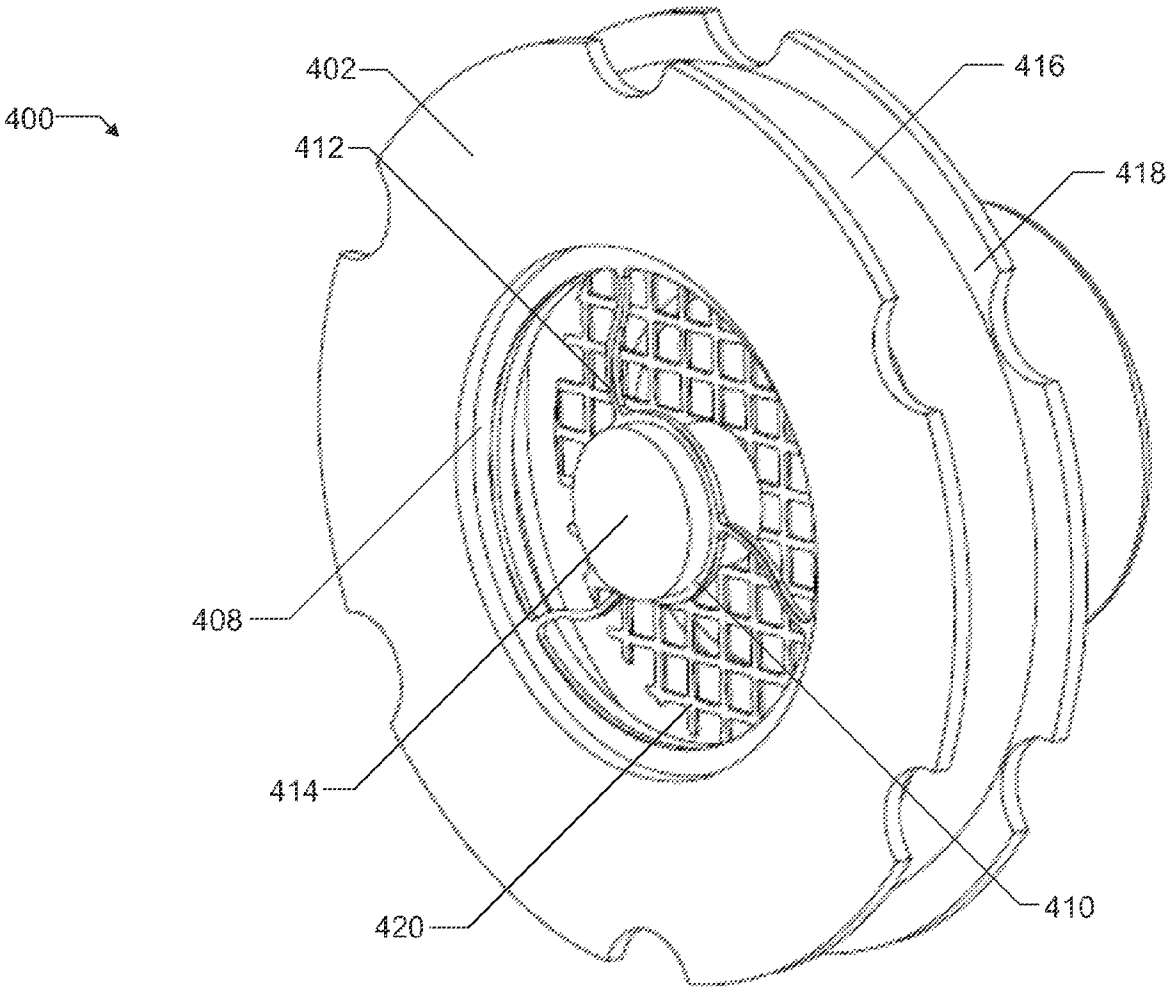
FIG. 4 is a perspective view of a cathode assembly in accordance with the present disclosure that includes a cathode grid.

In some applications, the cathode assembly 400 may include an additional support 418 coupled to the support 402 by an insulator 416, as shown in FIG. 4. The additional support 418 may have a hole formed therein, and a cathode grid 420 extends across the hole. During operation, there may be a voltage difference between the ohmically heated cathode 414 and the cathode grid 420 that serves to extract electrons from the ohmically heated cathode, and to accelerate the electrons downstream.

While the disclosure has been described with respect to a limited number of embodiments, those skilled in the art, having benefit of this disclosure, will appreciate that other embodiments can be envisioned that do not depart from the scope of the disclosure as disclosed herein.

The invention claimed is:

1. A cathode assembly for use in a downhole radiation generator comprising:
- an ohmically heated cathode; and
- a support having formed therein a hole and a recess at least partially surrounding the hole;
- a mount coupled to the support and comprising
  - a larger outer frame positioned within the recess,
  - a smaller inner frame carrying the ohmically heated cathode and spaced apart from the larger outer frame, and
  - a plurality of members coupling the smaller inner frame to the larger outer frame.

2. The cathode assembly of claim 1, wherein at least one member of the plurality thereof extends in a straight line from the smaller inner frame to the larger outer frame.

3. The cathode assembly of claim 1, wherein at least one member of the plurality thereof extends in a meandering path from the smaller inner frame to the larger outer frame.

4. The cathode assembly of claim 1, wherein at least one member of the plurality thereof extends from the smaller inner frame to the larger outer frame in a direction orthogonal to the ohmically heated cathode.

5. The cathode assembly of claim 1, wherein at least one member of the plurality thereof extends from the smaller inner frame to the larger outer frame in a direction oblique to the ohmically heated cathode.

6. The cathode assembly of claim 1, wherein the support comprises a hollow cylinder.

7. The cathode assembly of claim 1, wherein the hole has a circular cross section.

8. The cathode assembly of claim 1, wherein the recess has a circular cross section.

9. The cathode assembly of claim 1, wherein the larger outer frame comprises a hollow cylinder.

10. The cathode assembly of claim 1, wherein the support has a plurality of heat conduction decreasing features.

11. The cathode assembly of claim 10, wherein the plurality of heat conduction decreasing features comprise depressions and/or projections and/or holes.

12. The cathode assembly of claim 1, wherein the smaller inner frame comprises a hollow cylinder.

13. The cathode assembly of claim 1, further comprising an additional support, and an insulator coupling the support to the additional support.

14. The cathode assembly of claim 13, wherein the additional support has a hole formed therein; and further comprising a cathode grid extending across the hole in the additional support.

15. A neutron or X-ray generator tube comprising:
a housing to contain an ionizable gas;
an extractor electrode carried within the housing;
a cathode assembly carried within the housing and comprising
an ohmically heated cathode,
a support having formed therein a hole and a recess at least partially surrounding the hole,
a mount coupled to the support and comprising
a larger outer frame positioned within the recess,
a smaller inner frame carrying the ohmically heated cathode and spaced apart from the larger outer frame, and
a plurality of members coupling the smaller inner frame to the larger outer frame, and
a cathode grid downstream of the ohmically heated cathode,
the cathode grid and the ohmically heated cathode having a voltage difference such that the ohmically heated cathode emits electrons in a downstream direction toward the extractor electrode,
the cathode grid and the extractor electrode having a voltage difference such that the electrons are decelerated toward the extractor electrode, at least some of the electrons as they travel interacting with the ionizable gas to form ions; and
a target carried within the housing downstream of the extractor electrode;
the extractor electrode and the target having a voltage difference such that the ions are accelerated downstream toward the target, the target to emit radiation when struck by at least some of the ions.

16. The radiation generator of claim 15, wherein at least one member of the plurality thereof extends in a straight line from the smaller inner frame to the larger outer frame.

17. The radiation generator of claim 15, wherein at least one member of the plurality thereof extends in a meandering path from the smaller inner frame to the larger outer frame.

18. The radiation generator of claim 15, wherein at least one member of the plurality thereof extends from the smaller inner frame to the larger outer frame in a direction orthogonal to the ohmically heated cathode.

19. The radiation generator of claim 15, wherein at least one member of the plurality thereof extends from the smaller inner frame to the larger outer frame in a direction oblique to the ohmically heated cathode.

20. A downhole radiation generator comprising:
a housing;
an extractor electrode carried within the housing;
a cathode assembly carried within the housing and comprising
an ohmically heated cathode,
a support having formed therein a hole and a recess at least partially surrounding the hole,
a mount coupled to the support and comprising
a larger outer frame positioned within the recess,
a smaller inner frame carrying the ohmically heated cathode and spaced apart from the larger outer frame, and
a plurality of members coupling the smaller inner frame to the larger outer frame, and
a cathode grid downstream of the ohmically heated cathode,
the cathode grid and the ohmically heated cathode having a voltage difference such that the ohmically heated cathode emits electrons in a downstream direction toward the extractor electrode,
the cathode grid and the extractor electrode having a voltage difference such that the electrons are accelerated toward a focusing electrode;
and
a target carried within the housing downstream of the extractor electrode;
the extractor electrode and the target having a voltage difference such that the electrons are accelerated downstream toward the target, the target to emit radiation when struck by at least some of the electrons.

21. The radiation generator of claim 20, wherein at least one member of the plurality thereof extends in a straight line from the smaller inner frame to the larger outer frame.

22. The radiation generator of claim 20, wherein at least one member of the plurality thereof extends in a meandering path from the smaller inner frame to the larger outer frame.

23. The radiation generator of claim 20, wherein at least one member of the plurality thereof extends from the smaller inner frame to the larger outer frame in a direction orthogonal to the ohmically heated cathode.

24. The radiation generator of claim 20, wherein at least one member of the plurality thereof extends from the smaller inner frame to the larger outer frame in a direction oblique to the ohmically heated cathode.

25. A method of making a cathode assembly for use in a neutron or X-ray radiation generator comprising:
forming a hole and a recess at least partially surrounding the hole in a support;
coupling a mount to the support by
positioning a larger outer frame within the recess,
positioning an ohmically heated cathode in a smaller inner frame spaced apart from the larger outer frame, and
coupling the smaller inner frame to the larger outer frame using a plurality of members.

26. The method of claim 25, wherein coupling the mount to the support further comprises brazing the ohmically heated cathode to the smaller inner frame.

27. The method of claim 25, wherein coupling the mount to the support further comprises welding a larger inner frame to the mount.

* * * * *